United States Patent [19]

Katagi et al.

[11] 4,356,494

[45] Oct. 26, 1982

[54] DUAL REFLECTOR ANTENNA

[75] Inventors: Takashi Katagi; Shuji Urasaki; Takashi Ebisui, all of Kamakura; Katsuhiko Aoki, Amagasaki, all of Japan

[73] Assignee: Mitsubishi Denki Kabushiki Kaisha, Tokyo, Japan

[21] Appl. No.: 227,902

[22] Filed: Jan. 23, 1981

[30] Foreign Application Priority Data

Jan. 30, 1980 [JP] Japan ..... 55-9729

[51] Int. Cl.[3] ..... H01Q 19/19

[52] U.S. Cl. ..... 343/781 CA

[58] Field of Search ..... 343/781 P, 781 CA, 837, 343/840, DIG. 2

[56] References Cited

U.S. PATENT DOCUMENTS

| | | | |
|---|---|---|---|
| 3,821,746 | 6/1974 | Mizusawa | 343/781 |
| 4,044,361 | 8/1977 | Yokoi et al. | 343/754 |
| 4,062,018 | 12/1977 | Yokoi et al. | 343/754 |

OTHER PUBLICATIONS

Hogg & Semplak; An Experimental Study of Cassegrainian Antennas; Bell System Technical Journal; Nov. 1964, pp. 2677–2704.

Hannan; Microwave Antennas Derived from Cassegrain Telescope, IRE Transactions on Antennas and Propagation Mar. 1961, pp. 140–153.

Potter; Application of Cassegranian Principle-to-Space Comm., IRE Trans. on Space Electronics and Telemetry, Jun. 1962, pp. 154–158.

*Primary Examiner*—Eli Lieberman

*Attorney, Agent, or Firm*—Sughrue, Mion, Zinn, Macpeak & Seas

[57] ABSTRACT

An earth station antenna is employed for telecommunicating with a satellite in combination with an automatic tracking apparatus. The antenna is a dual reflector antenna which comprises a main reflector, a sub-reflector and a primary radiator, and the used frequency band of the antenna is at least 1.8 octaves. A parameter t of the antenna, defined by a configuration of the primary radiator is less than 0.3 at the lowest operating frequency. The phase center of the primary radiator, at a low frequency within the operating frequency range, is made to correspond with the focus of the sub-reflector.

The above parameter t is defined by:

$$t = \frac{D_h^2}{8\lambda}\left(\frac{1}{L_h} + \frac{1}{L_s}\right)$$

where:

$\lambda$: wavelength in free space, $D_h$: aperture diameter of the primary radiator, $L_h$: center axial length from the radiator apex to the radiator aperture plane, and $L_s$: length from the radiator aperture plane to the bottom surface of the sub-reflector.

4 Claims, 6 Drawing Figures

DUAL REFLECTOR ANTENNA

BACKGROUND OF THE INVENTION

1. Field of the Invention

This invention relates to an earth station antenna of the type having a main reflector, a sub-reflector and a primary radiator, and more specifically to such an antenna having a substantially equal radiation pattern over a frequency band of more than 1.8 octaves.

2. Description of the Prior Art

An antenna of this general type, as shown in FIG. 1 includes a primary radiator 1, a subreflector 2 having a convex configuration defined by a portion of a hyperboloid of revolution, and a main reflector 3 having a concave configuration similarly defined by a portion of a hyperboloid. Greater detail of such an antenna configuration may be found in U.S. Pat. No. 4,186,402.

When the above antenna is designed, the primary radiator is designed to provide a t parameter of more than 0.4 at the lowest operating frequency to thereby reduce the frequency dependency of the primary radiating characteristics, i.e. to obtain high performance over a wide frequency range. The above t parameter is represented by the formula:

$$t = \frac{D_h^2}{8\lambda}\left(\frac{1}{L_h} + \frac{1}{L_s}\right)$$

where $\lambda$ is the wavelength in free space, $D_h$ is the aperture diameter of the primary radiator, $L_h$ is the length from the apex of the horn to the aperture plane, and $L_s$ is the length from the aperture plane to the bottom surface of the sub-reflector.

Further, performance will deteriorate due to any misalignment of the phase center and, since this deterioration is greater at high frequencies, the phase center of the primary radiator at high frequencies is caused to coincide with the focal point of the sub-reflector.

A problem characteristic of such a conventional antenna, however, is that for a t parameter of more than 0.4 the beamwidth of the radiation pattern from the main reflector is inversely proportional to the frequency, so that when the frequency range covers 1.8 octaves, the high frequency beamwidth will be about one third that at the low frequencies.

Further, antenna gain is higher at high frequencies than at low frequencies, and when such a dual reflector antenna is used as an earth station antenna for tracking satellites, the main reflector has to be of a certain minimum size in order to ensure sufficient gain at low frequencies. However, larger diameter antennas result in even narrower beamwidths, and as a consequence the high frequency beamwidth is extremely narrow. Also, due to the inherent increase in antenna gain at higher frequencies, the gain at high frequencies may be far in excess of the gain required for tracking, but this gain cannot be decreased without also unacceptably decreasing the gain at lower frequencies.

These narrow beamwidths are undesirable in satellite tracking systems since they require that the tracking accuracy of the antenna be very high. For example, when frequencies in the 4, 6, 11 and 14 GHz bands are employed with an earth station antenna of about 30 meters in diameter, the beamwidths become 0.15°, 0.10°, 0.048°, 0.04°, respectively. In an antenna of this size, however, it is difficult to achieve an automatic tracking error of less than ±0.01°, and it is therefore difficult to keep the beam trained on the satellite for maximum gain.

SUMMARY OF THE INVENTION

In this invention, a main reflector having large frequency characteristics is employed for eliminating the above defects, and it is an object of this invention to obtain an antenna having a substantially equal radiation pattern over a wide frequency band.

Briefly, this is achieved by a dual reflector antenna according to the present invention which comprises a main reflector, a sub-reflector and a primary radiator, the usable frequency band of which antenna is at least than 1.8 octaves. The antenna has a t parameter which is less than 0.3 at the lowest usable frequency and it is arranged such that the phase center of the primary radiator at a relatively low frequency coincides with the focal point of the sub-reflector.

DESCRIPTION OF THE PREFERRED EMBODIMENTS

Figure 1:
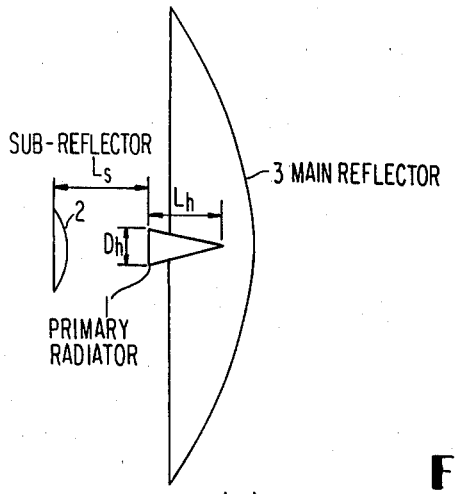
FIG. 1 is a cross-sectional view showing an arrangement of both a conventional antenna and of an antenna according to the invention.
Figure 2A:
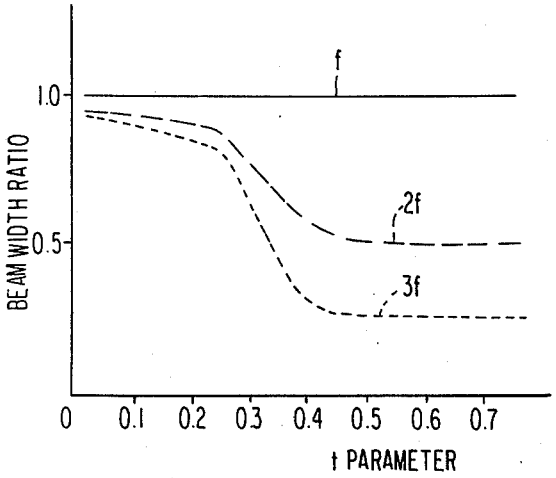
FIGS. 2(*a*) and (*b*) are graphs which show the relationship of the beamwidth of the radiation pattern from the main reflector and the edge level of the main reflector to the configuration of the primary radiator.
Figure 2B:
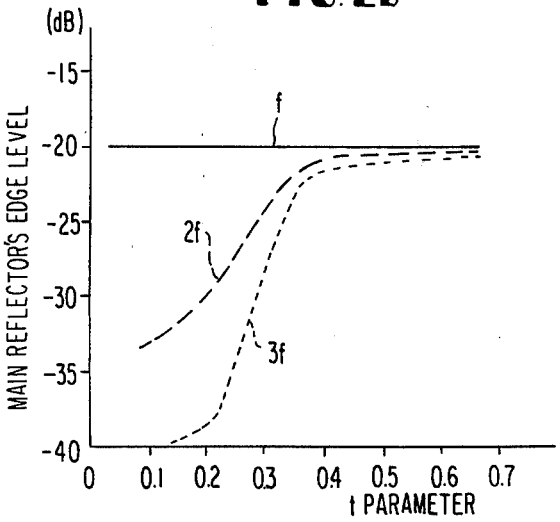

The basic configuration of this invention is the same as that shown in FIG. 1. FIGS. 2(*a*) and (*b*) show relationships of the beamwidth of the radiation pattern from the main reflector and the edge level of the main reflector, respectively, when frequencies 2f or 3f are radiated by the primary radiator 1, the primary radiator being selected so that the edge level of the main reflector is −20 dB at frequency f. With a t parameter in excess of 0.4, as in a conventional antenna, FIG. 2(*b*) shows that the primary radiation pattern changes very little with respect to frequency, and therefore the variation in the edge level of the main reflector is small, and FIG. 2(*a*) shows that for a t parameter greater than 0.4 the beamwidth is inversely proportional to frequency. Thus, at high frequencies the beamwidth may become too narrow for easy satellite tracking.

With a t parameter of less than 0.3 in an antenna according to the present invention, FIG. 2(*a*) shows that the beamwidth will decrease very little with increasing frequency. Furthermore, with the phase center of the primary radiator corresponding to the focal point of the subreflector at low frequencies, the gain of the antenna at low frequencies is enhanced and the need for a very large dish reflector is lessened. Since the beamwidth will not decrease significantly at high frequencies and since a smaller dish reflector can be used, automatic satellite tracking will be much easier.

As the frequency increases, the gain of the antenna would ordinarily tend to increase. However, as shown in FIG. 2(*b*) the edge level of the main reflector will fall at higher frequencies and the antenna gain will also be reduced by the phase misalignment which will occur at high frequencies. The lowering of the edge level due to changing radiation pattern and the lowering of gain due to phase center misalignment will substantially offset any gain increase which would otherwise occur at higher frequencies. Thus, a substantially constant beamwidth and radiation pattern over a wide frequency range is realized.

Accordingly, if the dual reflector antenna of this invention is used as an earth station antenna for tracking satellites, it is economically advantageous as there is no necessity to use a high accuracy automatic tracking apparatus.

A preferred embodiment of the dual reflector antenna of this invention is as follows. Where the usable frequency band is about 1.8 octaves, being 4–14 GHz, the main reflector 3 is formed as a portion of a paraboloid of revolution and has a diameter of about a 30 m, and the sub-reflector is formed as a portion of a hyperboloid of revolution and has a diameter of about 3 m. The diameter $D_h$ of the aperture of the primary radiator is 0.5 m, the center axial length $L_h$ between the horn's apex and the aperture plane is 3.5 m, the length $L_s$ between the aperture plane and the bottom surface of the subreflector is 5 m. At 6 GHz, the phase center of the primary horn is designed to correspond to the focal point of the sub-reflector. With the abovementioned construction, the t parameter of the primary radiator at 4 GHz is 0.2.

Figure 4A:
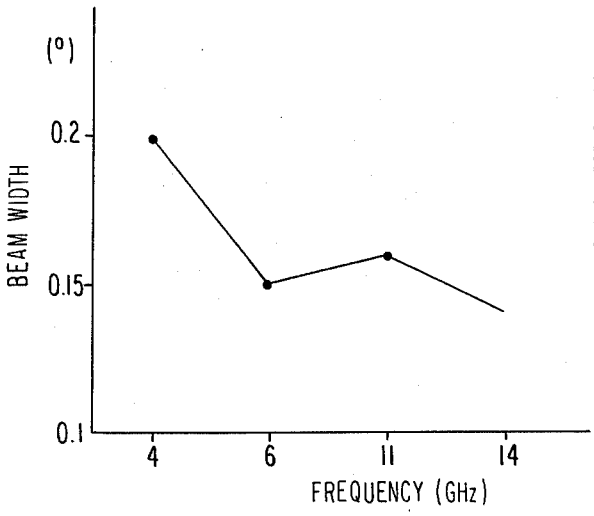
FIG. 4(*a*) and (*b*) are graphs which respectively show beamwidth and gain versus frequency with the antenna of this invention.
Figure 4B:
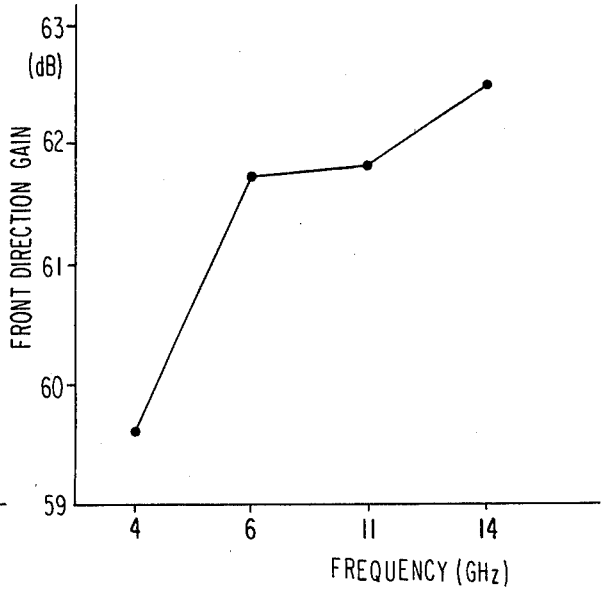
Figure 3:
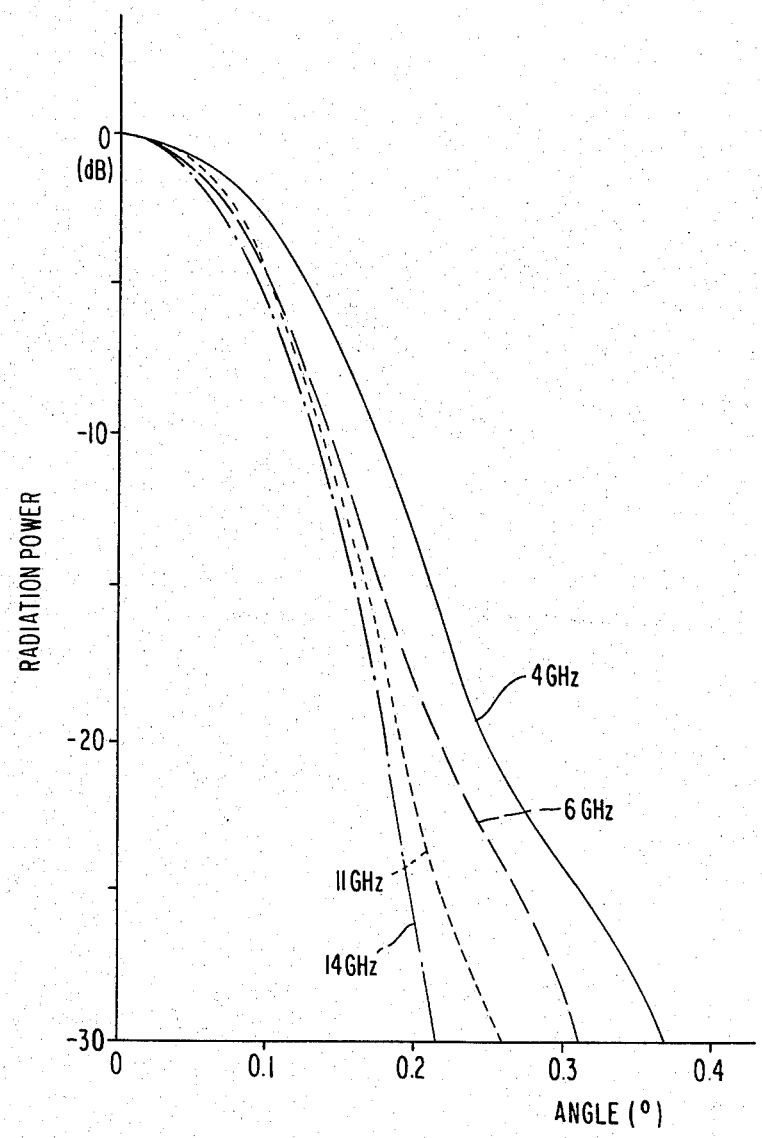
FIG. 3 is a graph showing the frequency characteristics of the radiation pattern of an antenna according to the invention.

FIG. 3 shows the radiated pattern of the abovementioned dual reflector antenna, and FIGS. 4(*a*) and (*b*) show relationships of the beamwidth and antenna gain, respectively, with frequency variation. As is seen in these Figs., the dual reflector antenna according to this invention has a substantially uniform beamwidth over a wide frequency band such as 4–14 GHz.

As mentioned above, this invention is applicable to a rotationally symmetrical Cassegrain antenna having a sub-reflector formed as a portion of a hyperboloid of revolution and main reflector formed as a portion of a paraboloid of revolution. However, this invention is not limited to the above antenna, but it is also applicable to a Gregorian antenna having a sub-reflector formed as a portion of an ellipsoid of revolution, and it may also be applicable to an offset-type antenna using asymmetric reflectors.

Moreover this invention is not limited to use with the above reflectors, being conicoids of revolution, but may be applied as well to an antenna using a shaped surface reflector.

Furthermore, in the above description of this invention the primary radiator which determines the phase center consists only of a radiating horn. However, the primary radiator may instead include both a radiating horn and a primary reflector system having a plurality of reflectors.

As is apparent from the above description, because the primary radiator or primary radiating system of this invention has a t parameter of less than 0.3, this invention makes it possible to obtain a dual reflector antenna whose radiation pattern has a substantially uniform beamwidth over a frequency band of greater than 1.8 octaves. If the dual reflector antenna of this invention is used as an earth station antenna for tracking satellites, it is economically advantageous since it is no longer necessary to use a high accuracy automatic tracking apparatus.

We claim:

1. In a dual reflector antenna having a usable frequency band of at least approximately 1.8 octaves, said antenna having a primary radiator having a radiating aperture for providing a radiated beam, said primary radiator including a horn having an apex, said antenna further comprising a main reflector and a sub-reflector for reflecting said radiated beam to said main reflector, said sub-reflector having a bottom surface which is closest to said primary radiator aperture, said antenna having a t parameter defined by:

$$t = \frac{D_h^2}{8\lambda}\left(\frac{1}{L_h} + \frac{1}{L_s}\right)$$

$\lambda$: wave length in free space of said radiated beam, $D_h$: diameter of the aperture of said primary radiator, $L_h$: the axial length between said apex of the horn and said aperture, $L_s$: the length between said aperture and said sub-reflector's bottom surface, the improvement comprising:

the value of said t parameter being less than 0.3 at the lowest usable frequency of said antenna; and the phase center of said primary radiator being substantially coincident with the focal point of said sub-reflector at a low frequency within said usable frequency band.

2. A dual reflector antenna as claimed in claim 1, wherein the reflecting surface of at least one of said main reflector and sub-reflector is of a configuration defined by a portion of a conicoid of revolution.

3. A dual reflector antenna as claimed in claim 2, wherein said conicoid of revolution is one selected from the group of a hyperboloid of revolution, a paraboloid of revolution, or an ellipsoid of revolution.

4. A dual reflector antenna as claimed in claim 1, wherein the reflecting surface of at least one of said main reflector and sub-reflector is of a configuration defined by a shaped surface.

* * * * *